United States Patent [19]

Dickerson et al.

[11] 4,176,415

[45] Dec. 4, 1979

[54] LOUNGE WITH ARTICULATED SIDE-BY-SIDE INDEPENDENTLY ADJUSTABLE LONGITUDINAL SECTIONS

[76] Inventors: Evelyn C. Dickerson, 415 N. Ireland St., Burlington, N.C. 27215; Ronald B. Jones, 901 Sixth St., SW., Washington, D.C. 20024

[21] Appl. No.: 892,164

[22] Filed: Mar. 31, 1978

[51] Int. Cl.[2] ..... A47C 21/00

[52] U.S. Cl. ..... 5/66; 5/68; 5/465; 128/33

[58] Field of Search ..... 5/60, 66, 68, 69, 327 R, 5/345, 352, 357; 128/1 R, 33; 297/416, 417

[56] References Cited

U.S. PATENT DOCUMENTS

| | | | |
|---|---|---|---|
| 2,445,158 | 7/1948 | Spankawk | 5/60 |
| 2,906,259 | 9/1959 | Adair, Jr. | 5/60 |
| 3,115,366 | 12/1963 | Glass | 297/417 |
| 3,656,190 | 4/1972 | Regan | 5/60 |
| 3,717,378 | 2/1973 | Lutehausky | 5/60 |
| 3,855,652 | 12/1974 | Nicholson | 5/345 R |

*Primary Examiner*—Casmir A. Nunberg
*Attorney, Agent, or Firm*—Herman L. Gordon

[57] ABSTRACT

A lounge having an angularly adjustable main forward section and a plurality of side-by-side longitudinal rearwardly extending additional sections adjustably pivotally connected to the main forward section, each longitudinal section consisting of a plurality of independently angularly adjustable articulated segments. Manually controlled means are provided for locking the main forward section and the longitudinal sections and articulated segments in adjusted positions to provide a selected desired surface contour, for example, to facilitate achievement of desired positions in the performance of sexual acts.

13 Claims, 18 Drawing Figures

LOUNGE WITH ARTICULATED SIDE-BY-SIDE INDEPENDENTLY ADJUSTABLE LONGITUDINAL SECTIONS

FIELD OF THE INVENTION

This invention relates to articles of furniture, and more particularly to adjustable chairs, beds and lounges.

BACKGROUND OF THE INVENTION

At the present time, available adjustable chairs, lounges and beds are segmented in a manner permitting adjustment only around transverse axes going completely across the entire width of the chair, lounge or bed, and not permitting angular adjustment of selected limited individual sections of the supporting surface. In typical prior art arrangements a backrest, seat or legrest may be angularly adjusted, for the comfort or convenience of a single occupant, but not in a manner useful for facilitating the achievement of the many positions desired in the performance of sexual acts by a pair of individuals. Using the known types of adjustable chairs, beds or lounges results in unnecessary discomfort and fatigue, and seriously detracts from the enjoyment of sexual activity, particularly for ailing or elderly persons, and often entirely deprives some handicapped persons of the ability to enjoy such activity.

SUMMARY OF THE INVENTION

Accordingly, a main object of the invention is to provide a novel and improved furniture article to be employed to support persons in a recumbent or semi-recumbent position which overcomes the deficiencies and disadvantages of the previously used adjustable chairs, beds and lounges.

A further object of the invention is to provide an improved furniture article which is adjustable for reducing discomforts and fatigue in attempting to achieve and enjoy the many positions that are desired in performing sexual intercourse, enabling and facilitating sexual activity by handicapped persons, ailing persons and elderly persons, and allowing such persons to achieve satisfaction and enjoyment through the use of comfortable positions that normally would be painful and/or cause quick fatigue.

A still further object of the invention is to provide a novel and improved furniture article for supporting individuals in recumbent or semi-recumbent positions, the furniture article being segmented in a manner permitting independent angular adjustment of many individual areas of the supporting surface, and not being limited to adjustment around a single common transverse axis but being adjustable relative to many spaced transverse axes at different levels, permitting desired surface contours to be achieved.

A still further object of the invention is to provide an improved multi-contour furniture article which is easy to adjust, which is relatively compact in size, which employs relatively simple and inexpensive components, and which permits individual angular and height adjustments of various portions of its supporting surface so that any desired contour pattern may be readily obtained, and so that in particular, the supporting surface may be contoured for maximum comfort and enjoyment in the performance of sexual intercourse.

A still further object of the invention is to provide an improved furniture article of the lounge type which has side-by-side longitudinal segments including hinged sections which are independently adjustable so as to achieve a desired contour for the supporting surface of the article.

A still further object of the invention is to provide an improved furniture article of the lounge type which has a supporting surface defined by a large number of independently angularly-adjustable supporting areas, enabling the supporting surface to be modified over a wide range of different surface contours.

A still further object of the invention is to provide an improved multi-contour lounge which has a plurality of side-by-side longitudinal segments, each of which contains independently adjustable hinged sections which can be easily adjusted in angular inclination and which are reliably locked in adjusted angular positions after adjustment.

A still further object of the invention is to provide an improved multi-contour furniture article of the lounge type which can be adjusted to a desired surface configuration by simple manual operations, and wherein the adjustments can be made quickly and without requiring the use of tools.

A still further object of the invention is to provide an improved adjustable-contour furniture article of the lounge type which has longitudinal contour adjustability as well as transverse contour adjustability, and which is relatively inexpensive to manufacture, which is neat in appearance, and which is durable in construction.

BRIEF DESCRIPTION OF THE DRAWINGS

Further objects and advantages of the invention will become apparent from the following description and claims, and from the accompanying drawings, wherein:

DESCRIPTION OF PREFERRED EMBODIMENTS

Figure 1:
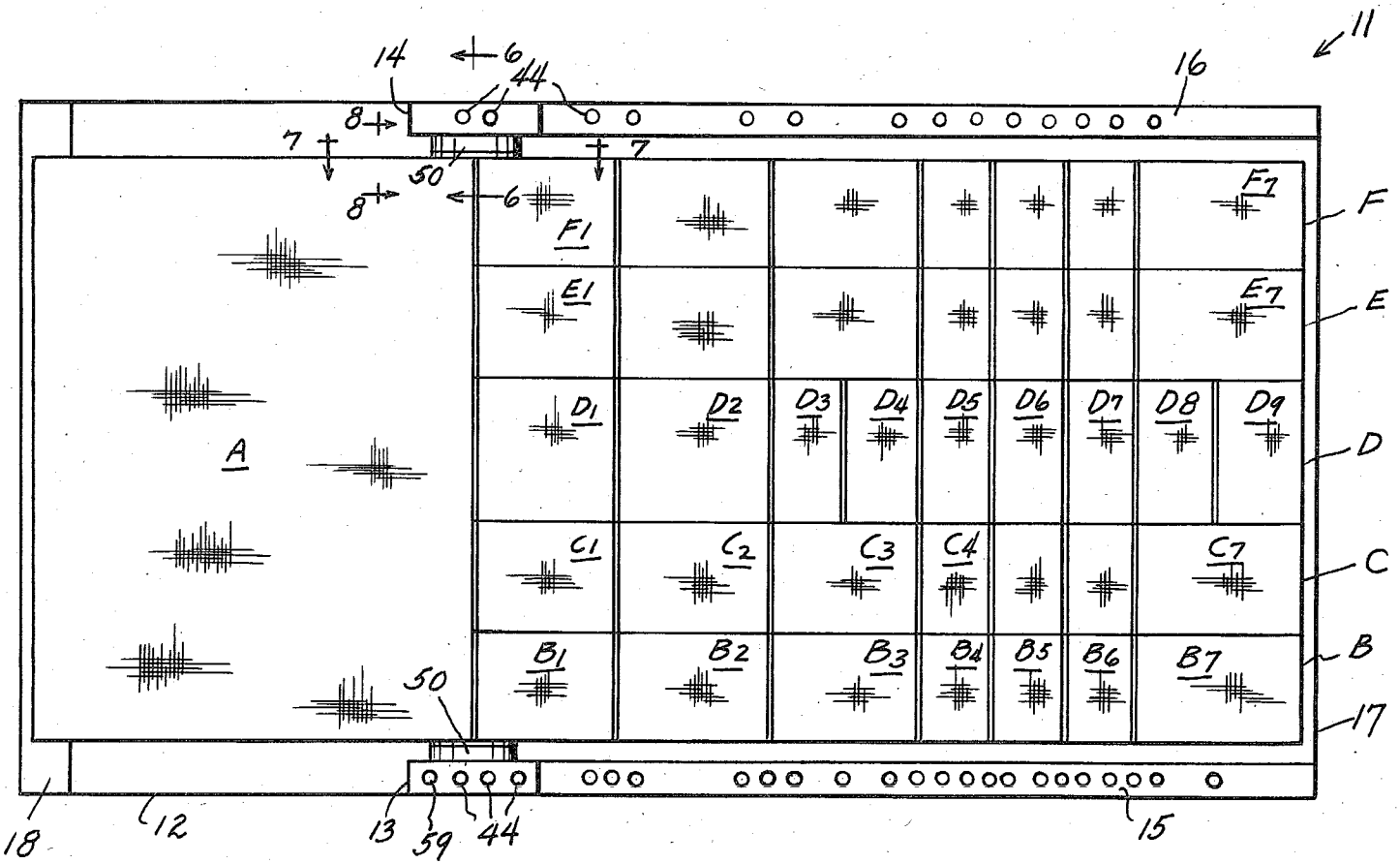
FIG. 1 is a top plan view of an improved multi-contour lounge-type furniture article constructed in accordance with the present invention.

Referring to the drawings, 11 generally designates a multi-adjustable-contour lounge constructured in accordance with the present invention. The lounge 11 comprises a suitable base, for example, a rectangular bottom platform 12 provided with transversely aligned upstanding hollow post members 13 and 14 at its opposite longitudinal sides, merging with respective upstanding hollow longitudinal wall members 15 and 16 which extend from said hollow post members to the rear end wall 17 of platform 12. The head, or forward, end of the platform 12 is provided with a transverse upstanding wall member 18 for a purpose presently to be described.

The lounge 11 comprises a suitably upholstered and cushioned relatively large main forward section A pivoted on a main transverse horizontal axis between the upstanding post members 13 and 14 on aligned fixed shaft elements 20,20 as will be presently described, and a plurality of side-by-side longitudinal rearwardly extending additional sections B to F adjustably pivoted to the main forward section A at said main horizontal transverse axis on fixed intervening shaft portions rigid and coaxial with the end shaft portions 20,20. The longitudinal sections B to F each consists of a plurality of independently angularly adjustable suitably upholstered and cushioned articulated segments, shown at $B_1$ to $B_7$, $C_1$ to $C_7$, $D_1$ to $D_9$, $E_1$ to $E_7$ and $F_1$ to $F_7$. The longitudinal sections may include segments of different longitudinal lengths, such as relatively long segments $B_1$, $B_2$, $B_3$ and $B_7$, with intervening shorter segments $B_4$–$B_6$, and may have different distributions of short and long segments, for example, the middle section D may comprise two long segments $D_1$, $D_2$ and remaining short segments $D_3$–$D_9$, as shown in FIG. 1. The segments are hinged on transverse axes, and each segment is independently angularly adjustable and is lockable in adjusted position, as will be presently described.

In the typical example illustrated in the drawings, the longitudinal articulated sections B, C, E and F have similar segment distributions, each comprising seven segments, whereas the intermediate longitudinal articulated section D has nine segments. The distribution pattern may vary in accordance with the number and nature of different surface contour configurations to be made available.

Figure 4:
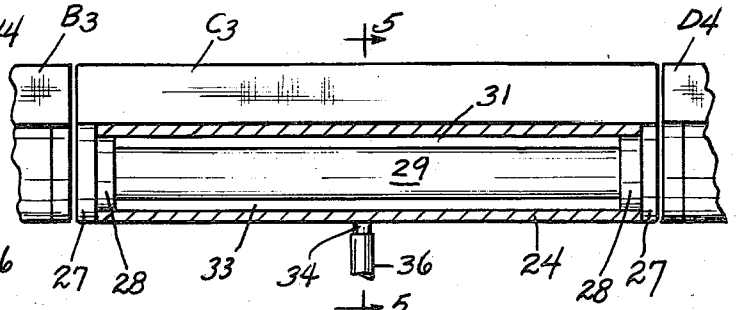
FIG. 4 is an enlarged fragmentary tranverse vertical cross-sectional view taken substantially on the line 4—4 of FIG. 2 and showing a typical hydraulically-locked hinge assembly employed between two adjacent surface-contour sections.
Figure 3:
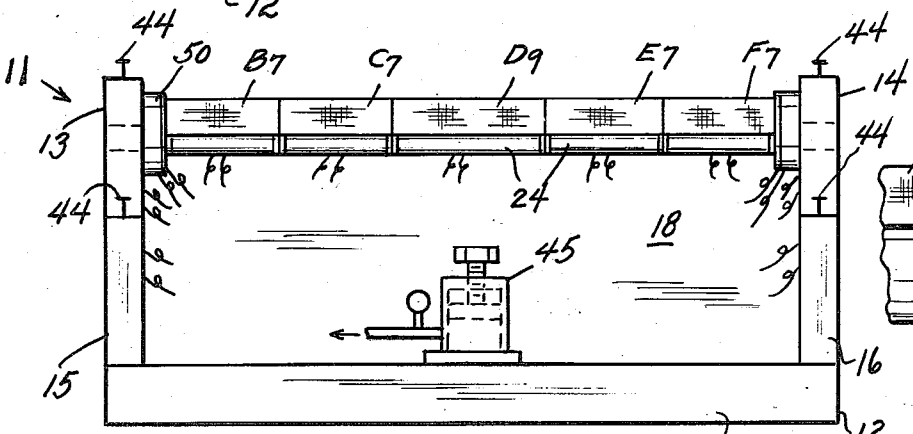
FIG. 3 is an end elevational view of the furniture article, taken substantially on the line 3—3 of FIG. 2.
Figure 5:
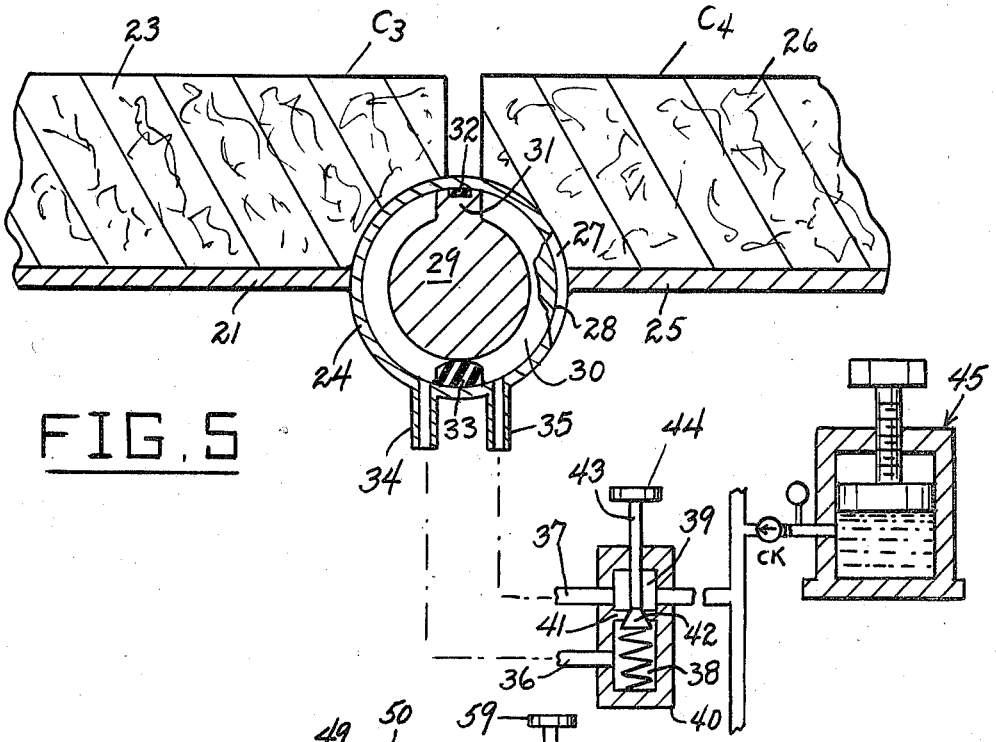
FIG. 5 is an enlarged fragmentary vertical cross-sectional view taken substantially on the line 5—5 of FIG. 4.

FIG. 4 and 5 illustrate a typical articulation hinge joint employed between longitudinally adjacent segments, for example, the segments $C_3$ and $C_4$. Segment $C_3$ may comprise a rigid bottom plate member 21 with a cushion element 23 cemented or otherwise suitably secured thereon. Rigidly secured to a transverse edge of plate member 21 is a cylindrical hinge sleeve 24. Segment $C_4$ comprises a rigid bottom plate member 25 with a cushion element 26 cemented or otherwise suitably secured thereon. Rigidly secured to a transverse edge of plate member 25 are axially aligned end discs 27,27 with inner reduced step elements 28,28 which form sealed bearings for and are received in the opposite ends of the cylindrical sleeve 24 and which are rigidly connected by a further reduced stem portion 29, defining an annular fluid space 30 between the cylindrical sleeve 24 and the stem portion 29. Stem portion 29 is integrally formed with a radial rib 31 coextensive with the stem portion and having a peripheral edge recess in which a resilient deformable sealing strip 32, extending around the edges of the rib, is secured, sealingly engaging the adjacent inside surfaces of cylindrical sleeve 24 and members 28,28.

Secured in the lower portion of sleeve 24, completely coextensive therewith, is a resilient deformable sealing bar 33 sealingly engaging stem portion 29 and members 28,28. Thus, bar 33 can seal the chambers of space 30 on opposite sides of bar 33 with respect to each other, said chambers comprising the respective opposite spaces between rib 31 and bar 33. These spaces are provided, on opposite sides of bar 33, as shown in FIG. 5, with conduit elements 34,35 which are connected by flexible conduits 36,37 to the respective lower and upper spaces 38,39 of an associated control valve 40. The valve housing has a partition 41 with a valve seat in which a spring-biased conical valve element 42 is normally engaged, sealing the fluid volumes on opposite sides of bar 33. The valve element 42 has an externally projecting stem 43 extending slidably and sealingly through the top wall of the valve housing and having an operating push button 44. By depressing push button 44, fluid circulation is permitted between the spaces on opposite sides of bar 33, allowing the segments $C_3$ and $C_4$ to be rotated relative to each other to establish a desired angle therebetween.

Hydraulic fluid is furnished to each upper valve chamber 39 from a conventional common fluid pressurizing unit 45 via a check valve. When button 44 is depressed, hydraulic fluid can be forced into both sides of the annular space 30 to completely fill the space with fluid. With no circulation permitted between said sides of the space (button 44 released) the hinge joint between the adjacent segments $C_3$,$C_4$ is locked.

Figure 6:
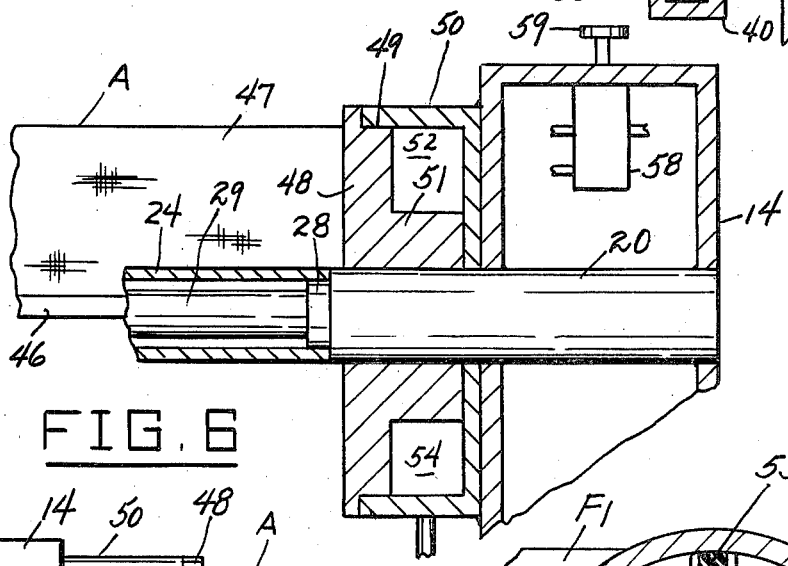
FIG. 6 is an enlarged fragmentary transverse vertical cross-sectional view taken substantially on the line 6—6 of FIG. 1.
Figure 8:
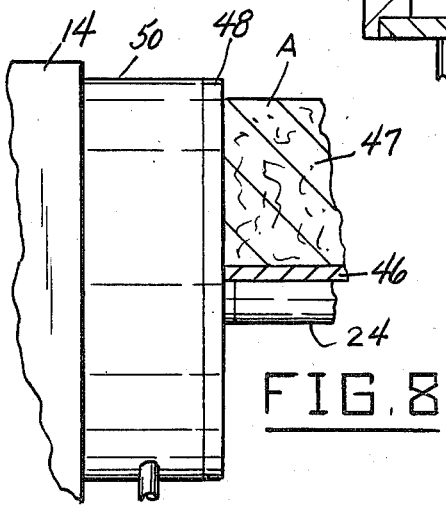
FIG. 8 is an enlarged fragmentary transverse vertical cross-sectional view taken substantially on the line 8—8 of FIG. 1.
Figure 7:
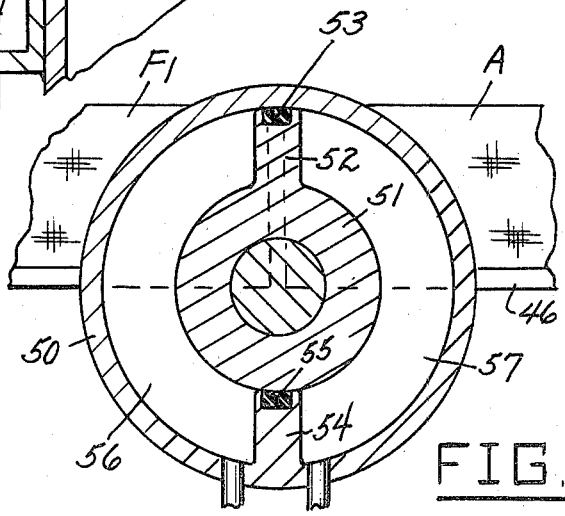
FIG. 7 is an enlarged fragmentary longitudinal vertical cross-sectional view taken substantially on line 7—7 of FIG. 1.

Similar hydraulically lockable hinge joints are provided between the other longitudinally adjacent segments of the system, each controlled by a respective by-pass valve 40. Similarly, hydraulic locking means is provided between main upholstered forward section A and the upholstered segments $B_1$ to $F_1$. This locking means is shown in detail in FIGS. 6, 7 and 8. Section A may have a rigid plate-like bottom member 46 on which a cushion element 47 is suitably secured. Rigidly secured to opposite corner portions of plate member 46 are axially aligned disc members 48 rotatably supportingly engaged on the fixed transversely aligned shaft elements 20 of post members 13,14, the disc members 48 having annular steps 49 sealingly and rotatably receiving the rim portions of cylindrical drum members 50,50 rigidly secured to the inside wall portions of the post members 13,14 coaxially with the fixed shaft elements 20. Said shaft elements 20 are rigidly connected by a series of stepped and reduced intermediate sections 28,29,28, similar to that shown in FIG. 4, rotatably and sealingly engaged by the cylindrical sleeve portions 24 of the respective upholstered segments $B_1$ to $F_1$ and having hydraulic hinge-locking means similar to the means described in connection with the segments $C_3$,$C_4$.

Each disc member 48 has a reduced inner step 51 provided with a coextensive radial rib 52 (see FIG. 7) provided with a resilient deformable sealing strip 53 sealingly engaging the adjacent inside surfaces of its associated drum 50, and the drum has an opposite inwardly projecting coextensive rib 54 provided with a resilient deformable sealing strip 55 sealingly engaging the adjacent surfaces of step 51 and defining fluid locking spaces 56,57 on opposite sides thereof. These spaces are controlled by a push button-operated by-pass valve 58 having the push button 59, and are supplied with hydraulic fluid from the common pressurized source 45 in the same manner as described above in connection with the control valves for the hinge joints of the upholstered minor segments. The inclination of main forward section A may be adjusted by depressing push button 59, manually setting section A to its desired angle, and then releasing the push button.

Figure 9:
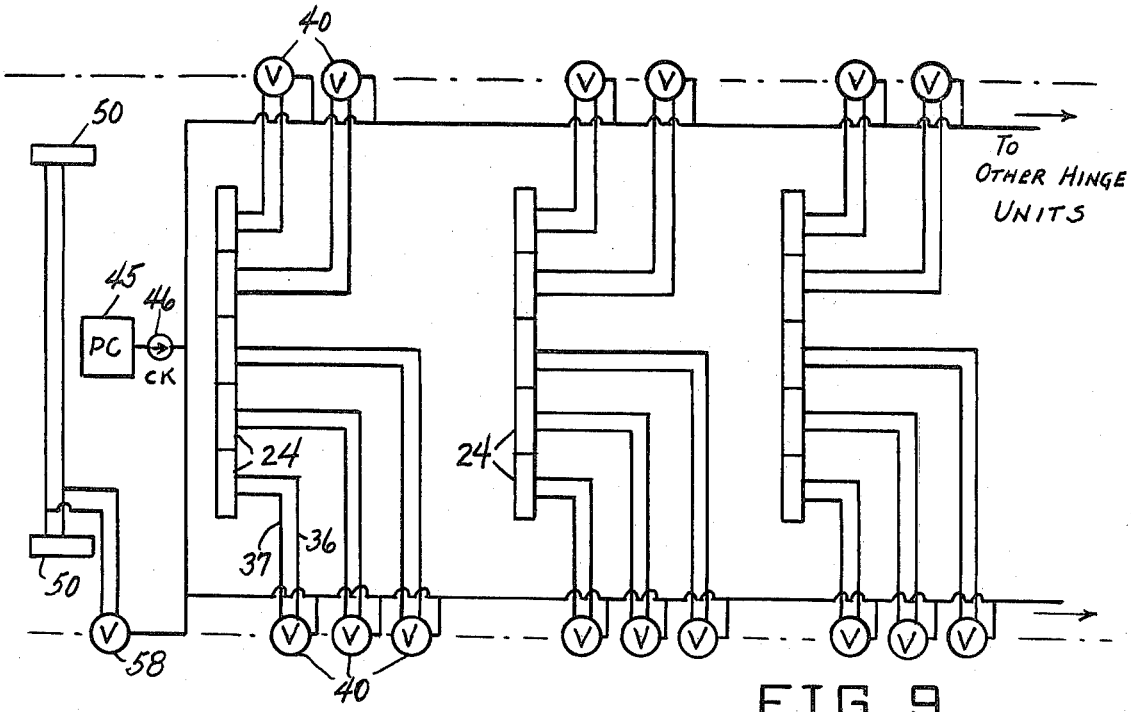
FIG. 9 is a partial schematic diagram of the hydraulic hinge-locking system employed in the furniture article of FIGS. 1 to 8.

The drums 50,50 are connected in parallel and are simultaneously controlled by the single by-pass valve 58, as shown by the hydraulic circuit diagram of FIG. 9.

Figure 2:
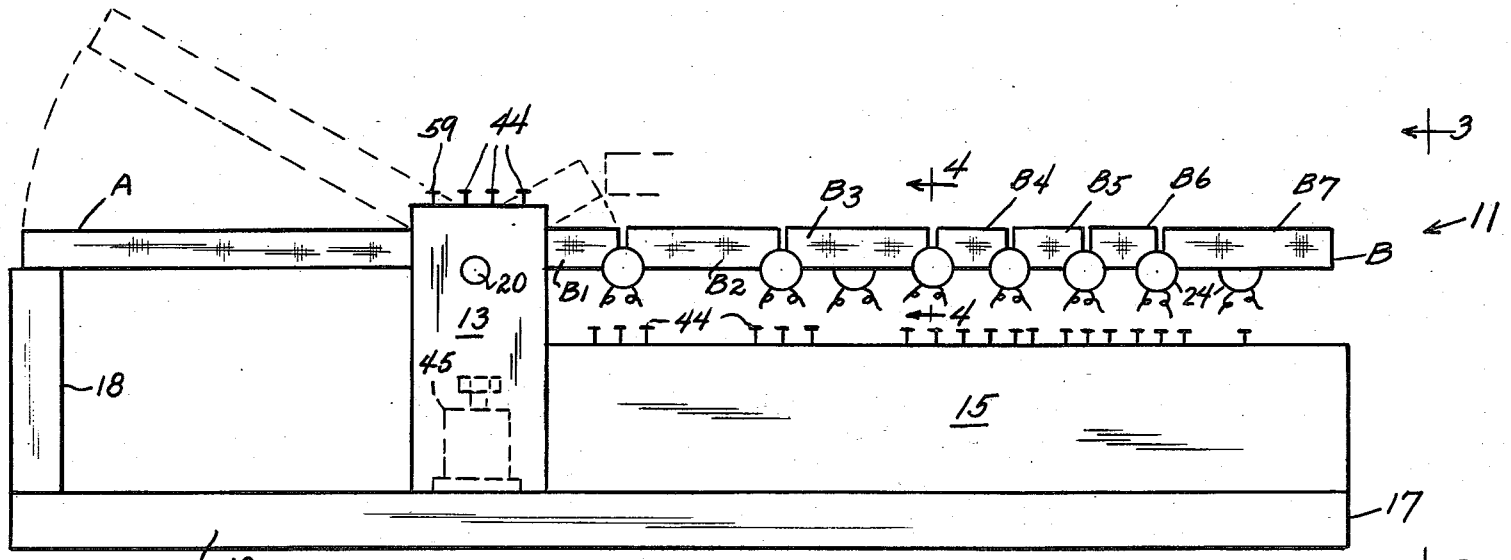
FIG. 2 is a side elevational view of the furniture article of FIG. 1.

The transverse wall member 18 may be employed as a support for the forward main section A when said section A is in its lower-most position, for example, when it is horizontal, as shown in full-line view in FIG. 2.

The hinge lock-controlling by-pass valves may be located in positions convenient for simultaneously manipulating their associated upholstered elements. A typical arrangement, shown in the drawings, is to mount the valves in the upstanding post members 13,14 and the housings 15,16 conveniently near their associated upholstered elements, with the valve push buttons 59 and 44 spaced along the top walls of post members 13,14 and housings 15,16 so as to be proximal to the hinge joints to be controlled. This arrangement allows the lounge contour to be easily adjusted by a single individual.

Various other convenient locations of the by-pass valve-controlling push buttons may be employed.

Figure 10A:
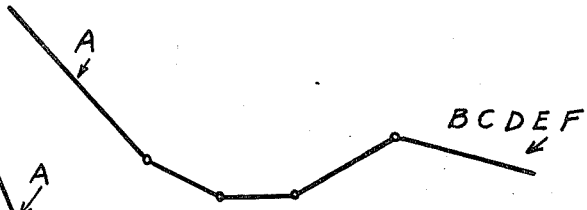
FIGS. 10A to 10F are line diagrams illustrating various typical adjusted-contour positions obtainable with the furniture article of FIGS. 1 to 9.
Figure 10B:
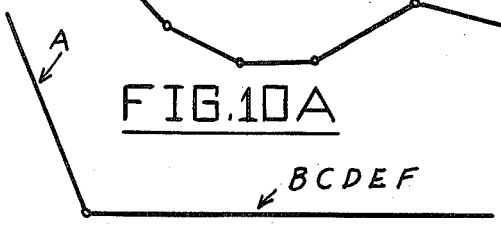
Figure 10E:
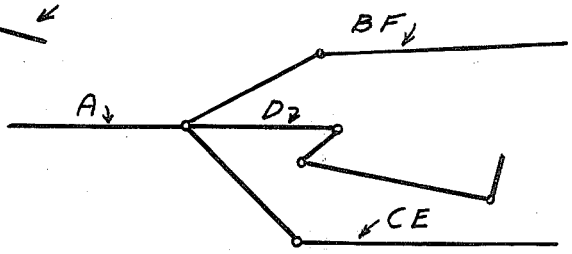
Figure 10C:
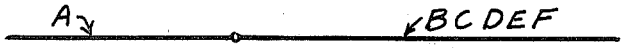
Figure 10F:
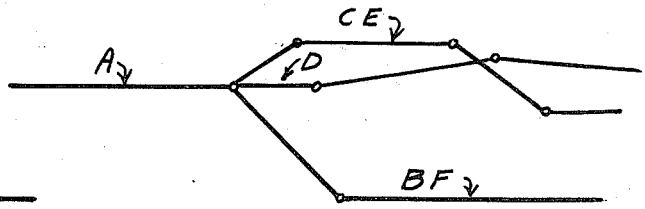
Figure 10D:
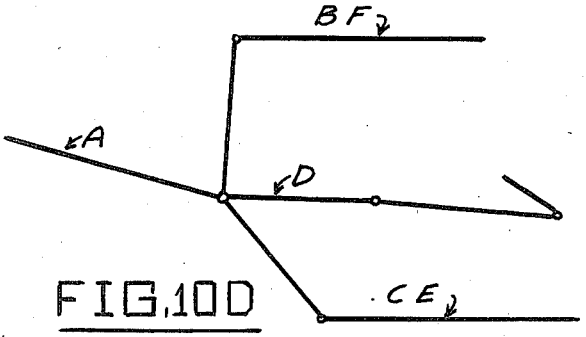

The adjustable elements of the lounge 11 may therefore be set to provide a wide range of different surface contours, as required to facilitate different types of desired user positions. A number of typical contour settings are diagrammatically illustrated in FIGS. 10A to 10F, wherein the various configurations of the lounge sections are labelled in accordance with side elevational views thereof. Thus, FIGS. 10A, 10B and 10C designate settings where the various segment surfaces are transversely coplanar, although in FIG. 10C the lounge surface is totally horizontal, in FIG. 10B only the main forward section A is inclined, and in FIG. 10A the longitudinal sections B,C,D,E and F are arranged to have the same profile. FIGS. 10D to 10F designate various arrangements wherein the longitudinal sections BF, D and CE are arranged to have different profiles in accordance with desired different user positions. For example, in FIG. 10D, the longitudinal sections B and F are arranged with one common profile and the sections C and E are arranged with another common profile, the middle longitudinal section D being arranged with still another profile, sections BF being elevated and sections CE being depressed relative to middle section D. As will be apparent, a large number of useful different configurations may be achieved.

Figure 12:
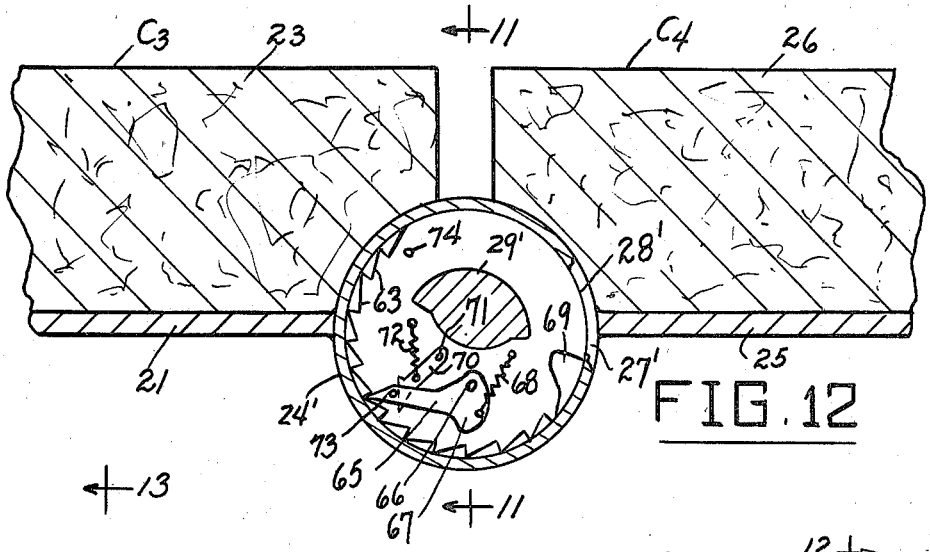
FIG. 12 is a vertical cross-sectional view taken substantially on line 12—12 of FIG. 11.
Figure 11:
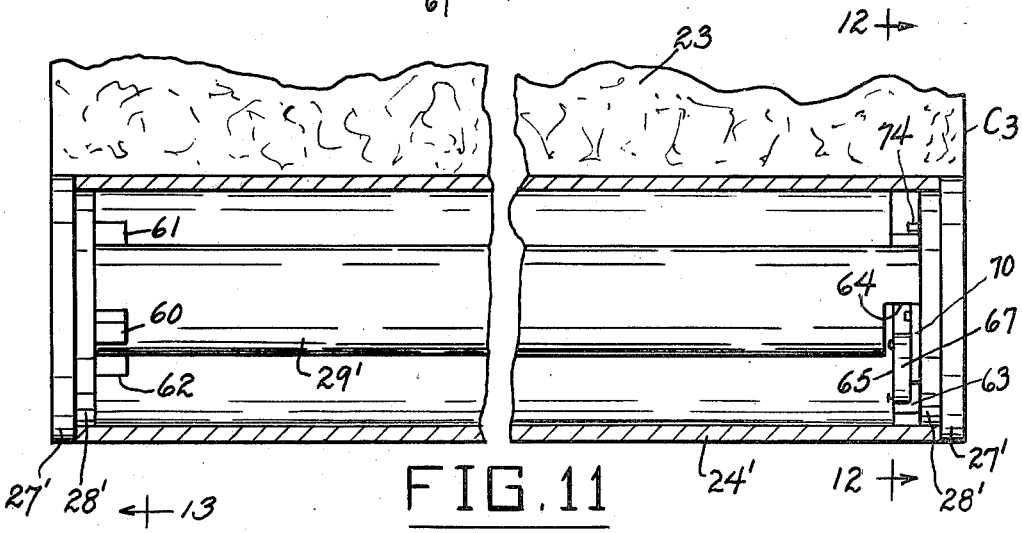
FIG. 11 is an enlarged fragmentary vertical cross-sectional view similar to FIG. 4, but illustrating a mechanically-latched hinge assembly which may be employed in the furniture article as an alternative to employing hydraulically-locked hinge assemblies, FIG. 11 being taken substantially on the line 11—11 of FIG. 12.
Figure 13:
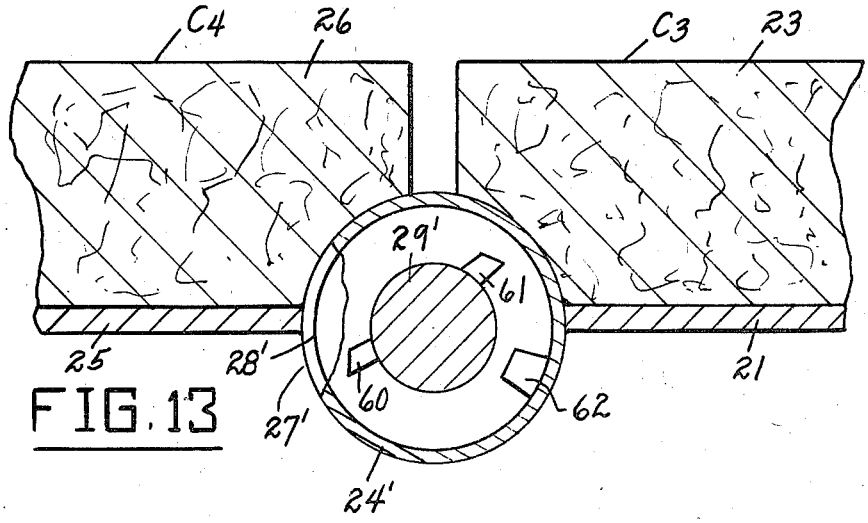
FIG. 13 is a vertical cross-sectional view taken substantially on line 13—13 of FIG. 11.

The hydraulic hinge-locking arrangements shown in FIGS. 1 to 9 represent only one type of hinge locking means which may be employed in connection with a multi-sectioned and articulated furniture article according to the present invention. Equivalent electrical, electro-mechanical or mechanical hinge locking means may be employed instead of the above-described hydraulic means. FIGS. 11 to 13 illustrate, for example, a mechanically-latched hinge assembly which may be employed in a furniture article according to the present invention instead of the previously described hydraulic hinge-locking means. Thus, FIG. 12 is a cross-sectional view similar to FIG. 5, disclosing a hinge assembly between adjacent typical upholstered segments $C_3$, $C_4$. Designated at 24' is a cylindrical hinge sleeve rigidly secured to a transverse edge of bottom plate member 21 of segment $C_3$. Rigidly secured to the corner portions of the adjacent transverse edge of the bottom plate member of segment $C_4$ are axially aligned end discs 27',27' with inner reduced step elements 28',28' which form bearings for and are received in the opposite ends of the cylindrical sleeve 24' and which are rigidly connected by a further reduced stem portion 29'.

At the left end of the hinge assembly, as viewed in FIG. 11, stem portion 29' is provided with spaced stop lugs 60,61 and sleeve member 24' is provided with an inwardly projecting stop lug member 62 cooperating with the stem-carried lugs 60,61 to limit rotation of segment $C_3$ relative to segment $C_4$ (see FIG. 13).

At the right end of the hinge assembly, as viewed in FIG. 11, sleeve member 24' is provided with inwardly projecting ratchet teeth 63 and stem member 29' is notched away at 64 to define a clearance space for a pawl member 65 pivoted to the adjacent step member 28' at 66 and biased counterclockwise, as viewed in FIG. 12, by a coiled spring 68 attached between a cam-shaped element 67 on said pawl member and the adjacent step member 28'. This urges the free end of pawl member 65 into latching engagement with the ratchet teeth 63, allowing segment $C_4$ to be freely rotated counterclockwise relative to segment $C_3$, as viewed in FIG. 12, but normally preventing relative clockwise rotation, (as viewed in FIG. 12) of said segment $C_4$. An inwardly projecting cooperating cam element 69 is provided in sleeve 24' at the end of the series of ratchet teeth 63, engageable by cam element 67 to rotate pawl member 65 inwardly away from ratchet teeth 63 when segment $C_4$ reaches the limit of its counterclockwise rotation, as viewed in FIG. 12, relative to segment $C_3$, namely, shortly before stem lug 61 encounters hinge sleeve lug 62 (this corresponds to the limit of clockwise movement of segment $C_4$ relative to segment $C_3$, as viewed in FIG. 13).

A latch arm 70 is pivoted at 71 to the step member 28' adjacent notch 64 and is spring-biased upwardly, as viewed in FIG. 12, by a coiled spring 72 connecting said arm to member 28'. Arm 70 has at its end a triangular hook element urged against a pin 73 on pawl member 65, which latches pawl member 65 in a retracted position responsive to the inward rotation of the pawl member caused by the engagement of cam element 67 with cam element 69. This frees segment $C_4$ for reverse (clockwise, as viewed in FIG. 12) rotation relative to segment $C_3$. Segment $C_4$ may then be rotated clockwise, as viewed in FIG. 12, through the limit of its permitted rotation relative to segment $C_3$. Shortly before stop lug 60 encounters stop lug 62, the triangular hook of latch arm 70 engages a pin 74 on the associated step member 28' which rotates the latch arm 70 backwardly against the pull of spring 72 sufficiently to disengage the hook from pin 73 and thereby releases the pawl member 65, so that it reengages with the ratchet teeth 63. Segment $C_4$ may then be rotated counterclockwise (as viewed in FIG. 12) relative to segment $C_3$ to establish a desired angle between segments $C_3$ and $C_4$, within the permitted range of angular adjustment.

The above-described mechanical hinge-adjusting and latching means may be employed both for adjusting the inclination of the main forward section A relative to the post members 13,14 and for the adjustment of angles between said forward section A and the adjacent segments $B_1$ to $F_1$, as well as between the successive adjacent segments of the longitudinal sections B to F.

The above-described embodiments may be incorporated in a furniture article having the appearance of a lounge which can be adjusted in a manner similar to a conventional chaise lounge but with additional adjustability for sexual activity. The adjustments in the embodiments above described are made manually, but it is contemplated that such adjustments may be made by employing suitable electric motors at the hinge joints to provide electrical operation, with control switches for the motors, said control switches being located on a conveniently accessible control panel, for example, at the foot end of the lounge. The lounge, when opened flat, may be employed as a bed, and may be designed, for example, to be approximately 8½ feet long and 4 feet wide when flat. The lounge may be fully foam-padded and may be completely finished in leather or other high quality, stain-resistant, leather-like material, such as Naugahide. The back rest (forward main section A) may be approximately 3 feet long and 4 feet wide, and may have built-in auxiliary equipment, such as an AM/FM stereo/tape unit with built-in speakers at each side and/or with twin stereo head phone sets, a built-in vibrator which can be used to vibrate the entire lounge surface, and with a high-intensity lamp carried on an adjustable arm. In the typical contemplated design, the remaining 5½ feet long portion comprises five primary longitudinal sections (B to F) segmented as above described into articulated segments. The center section (D) is approximately 1 foot wide and each of the other longitudinal sections (B, C, E, F) is approximately 9 inches wide. The two outer sections (B,F) may be operated together, but independently of the middle section (D), and the other two sections (C,E) may also be operated together. The operation may be manual for some models or motor-controlled for other models.

While certain specific embodiments of an improved furniture article have been disclosed in the foregoing description, it will be understood that various modifications within the spirit of the invention may occur to those skilled in the art. Therefore it is intended that no limitations be placed on the invention except as defined by the scope of the appended claims.

What is claimed is:

1. A furniture article comprising a base support, an angularly adjustable main forward section pivoted to said base support for rotation on a main fixed transverse horizontal axis, means to lock said forward section in an adjusted angular position, a plurality of side-by-side rearwardly extending longitudinal additional sections independently pivoted to said base support for rotation on said main transverse horizontal axis, means to lock said additional sections in independently adjusted angular positions, wherein said additional longitudinal sections each comprises a plurality of hinged segments, means to lock the segments in angularly adjusted positions relative to each other, and means for independently releasing the last-named segment angular position locking means.

2. The furniture article of claim 1, and wherein said base support has upstanding support means on opposite sides thereof and said main transverse axis is located at and extends transverse to said upstanding support means.

3. The furniture article of claim 1, and wherein there are at least three of said side-by-side additional independently pivoted longitudinal sections.

4. The furniture article of claim 3, and wherein each of said additional sections comprises a plurality of segments hinged together on transverse axes, and means to lock said segments in independently angularly adjusted positions relative to each other.

5. The furniture article of claim 4, and wherein at least one of said additional longitudinal sections includes segments of different longitudinal lengths.

6. The furniture article of claim 4, and wherein at least one of said additional longitudinal sections has segments different in number from the number of segments of the other additional longitudinal sections.

7. The furniture article of claim 4, and wherein the additional longitudinal sections include a middle section which has segments different in number from the number of segments of the other additional longitudinal sections.

8. The furniture article of claim 4, and wherein the additional longitudinal sections include a middle section which has a length distribution of segments different from the length distribution of the segments of the other additional longitudinal sections.

9. A furniture article comprising a base support, an angularly adjustable main forward section pivoted to said base support for rotation on a main fixed transverse horizontal axis, means to lock said forward section in an adjusted angular position, a plurality of side-by-side rearwardly extending longitudinal additional sections independently pivoted to said base support for rotation on said main transverse horizontal axis, and means to lock said additional sections in independently adjusted angular positions, and wherein said angular position locking means comprises respective hinge assemblies having cooperating relatively rotatable parts, said relatively rotatable parts being formed to define opposing fluid chambers, means to fill said opposing chambers with hydraulic fluid, and means to block circulation of fluid between the opposing chambers.

10. The furniture article of claim 9, and wherein said blocking means comprises normally closed by-pass valves connected across the opposing chambers.

11. The furniture article of claim 10, and manually operated means to at times open said by-pass valves to release the fluid for circulation between the opposing chambers.

12. A furniture article comprising a base support, and angularly adjustable main forward section pivoted to said base support for rotation on a main fixed transverse horizontal axis, means to lock said forward section in an adjusted angular position, a plurality of side-by-side rearwardly extending longitudinal additional sections independently pivoted to said base support for rotation on said main transverse horizontal axis, and means to lock said additional sections in independently adjusted angular positions, and wherein said angular position locking means comprises respective hinge assemblies having cooperating relatively rotatable parts, cooperating pawl and ratchet means connected between the relatively rotatable parts to limit relative rotation to one direction, and mean for at times disengaging said pawl and ratchet means for resetting the angular relationship between the relatively rotatable parts.

13. The furniture article of claim 12, and stop means establishing opposite end limits of relative rotation of said parts, means to disengage the pawl and ratchet means responsive to reaching one end limit, and means to reengage said pawl and ratchet means responsive to subsequently reaching the opposite end limit.

* * * * *